US008833812B2

(12) United States Patent
Sakai et al.

(10) Patent No.: US 8,833,812 B2
(45) Date of Patent: Sep. 16, 2014

(54) DOOR LOCK RELEASE MECHANISM FOR AUTOMOBILE DOOR

(75) Inventors: Yasunari Sakai, Kariya (JP); Takao Yamamoto, Kariya (JP); Tomochika Mizuta, Kariya (JP)

(73) Assignee: Toyota Shatai Kabushiki Kaisha (JP)

( * ) Notice: Subject to any disclaimer, the term of this patent is extended or adjusted under 35 U.S.C. 154(b) by 82 days.

(21) Appl. No.: 13/379,913

(22) PCT Filed: Jul. 31, 2009

(86) PCT No.: PCT/JP2009/063659

§ 371 (c)(1),
(2), (4) Date: Dec. 21, 2011

(87) PCT Pub. No.: WO2011/013242

PCT Pub. Date: Feb. 3, 2011

(65) Prior Publication Data

US 2012/0119519 A1 May 17, 2012

(51) Int. Cl.

| | |
|---|---|
| ***E05B 3/00*** | (2006.01) |
| ***E05B 85/16*** | (2014.01) |
| ***E05B 77/06*** | (2014.01) |
| ***E05B 77/04*** | (2014.01) |

(52) U.S. Cl.

CPC ..... *E05B 77/06* (2013.01); *E05B 85/16* (2013.01); *E05B 77/04* (2013.01); *Y10S 292/22* (2013.01); *Y10S 292/65* (2013.01)

USPC ..... 292/336.3; 292/DIG. 22; 292/DIG. 65

(58) Field of Classification Search

CPC ..... E05B 85/16; E05B 77/06; E05B 85/107; E05B 77/04; E05B 77/02

USPC ..... 292/DIG. 65, DIG. 22, 336.3

See application file for complete search history.

(56) References Cited

U.S. PATENT DOCUMENTS 4,995,654 A * 2/1991 Nishigami et al. ..... 292/216
6,070,923 A * 6/2000 Tanimoto et al. ..... 292/336.3

(Continued)

FOREIGN PATENT DOCUMENTS

JP 60-55672 B2 11/1980
JP 63-83365 U 11/1986

(Continued)

OTHER PUBLICATIONS

International Search Report prepared by the Japanese Patent Office on Oct. 27, 2009, for International Application No. PCT/JP2009/063659.

(Continued)

*Primary Examiner* — Kristina Fulton
*Assistant Examiner* — Faria Ahmad
(74) *Attorney, Agent, or Firm* — Sheridan Ross PC

(57) ABSTRACT

A door lock release mechanism includes a spacer 40, which is fixed to a handle base 14 and restricts depression of an outside handle in an inward direction of a vehicle when a door of the vehicle is deformed, and an engagement portion 40*a*, which is formed in the spacer 40 and arranged at a position outside the normal path of an opening operation of the door lock release mechanism. The engagement portion 40*a* is moved to a position in the path of the opening operation of the door lock release mechanism to restrict the opening operation of a latch open lever 30 through deformation of the door of the vehicle when a side collision occurs. As a result, simply through the engagement portion 40*a* formed in the spacer 40, which restricts displacement of the outside handle 16 in the inward direction of the vehicle, the unlocking operation of the latch open lever 30 is prevented to avoid unlocking of the door when the door is deformed through the side collision.

5 Claims, 7 Drawing Sheets

(56) References Cited

U.S. PATENT DOCUMENTS

| | | | | |
|---|---|---|---|---|
| 7,111,880 | B2 * | 9/2006 | Saitoh | 292/336.3 |
| 7,648,192 | B2 * | 1/2010 | Herline et al. | 296/187.12 |
| 8,079,631 | B2 * | 12/2011 | Higgins et al. | 296/146.1 |
| 8,128,151 | B2 * | 3/2012 | Teramoto et al. | 296/146.1 |
| 8,235,451 | B2 * | 8/2012 | Jordan et al. | 296/146.1 |
| 8,387,311 | B2 * | 3/2013 | Heller | 49/503 |
| 2003/0155780 | A1 * | 8/2003 | Bucker et al. | 292/336.3 |
| 2007/0013206 | A1 * | 1/2007 | Huttsell et al. | 296/146.6 |
| 2007/0024068 | A1 * | 2/2007 | Wood | 292/336.3 |
| 2007/0069525 | A1 * | 3/2007 | Ghannam | 292/216 |
| 2011/0095546 | A1 * | 4/2011 | Russell et al. | 292/216 |

FOREIGN PATENT DOCUMENTS

| | | | |
|---|---|---|---|
| JP | 2001-303825 | A | 10/2001 |
| JP | 2005-264662 | A | 9/2005 |
| JP | 2005-325569 | A | 11/2005 |
| JP | 4036316 | B2 | 1/2008 |

OTHER PUBLICATIONS

International Preliminary Report on Patentability prepared by the Japanese Patent Office on Feb. 10, 2012, for International Application No. PCT/JP2009/063659.

* cited by examiner

DOOR LOCK RELEASE MECHANISM FOR AUTOMOBILE DOOR

CROSS REFERENCE TO RELATED APPLICATIONS

This application is a national stage application under 35 U.S.C. 371 of PCT Application No. PCT/JP2009/063659 having an international filing date of 31 Jul. 2009 , which designated the United States, the entire disclosure of which is incorporated herein by reference.

FIELD OF THE INVENTION

The present invention relates to a door lock release mechanism for a vehicle door.

BACKGROUND OF THE INVENTION

Outside door handles for vehicle doors include pull-up type handles and grip-type handles. The pull-up types are pivotally supported in such a manner as to allow manipulation in a vertical direction. The grip-types are pivotally supported in such a manner as to allow manipulation in a horizontal direction.

A grip type outside handle includes a link lever, which is linked to the outside handle, and a release lever connected to the link lever. A latch open lever is linked to the release lever. When the outside handle is manipulated in an opening direction, which is a direction separating from a door outer panel (hereinafter, referred to as an "outer panel"), the latch open lever is operated through the link lever and the release lever to release the door lock.

In a vehicle involved in a side collision, an outside handle may displace in the opening direction due to inertia caused by impact on the corresponding door or through deformation of the outer panel of the door. As a result, through the side collision, the associated latch open lever may operate to release the door lock, thus causing the door to open.

Patent Document 1 proposes a technique for preventing unlocking of a door at the time when a side collision occurs to a vehicle. The technique includes an extended member arranged between an outer panel and the aforementioned release lever. If the outer panel deforms due to a side collision, the extended member is brought into contact with the release lever and thus deforms the release lever. This prevents the release lever from operating the latch open lever. Also, to facilitate deformation or collapse of the release lever at the time when the extended member contacts the release lever, a fragile portion is formed in the release lever.

However, the outside handle is repeatedly manipulated to open or close the door each time the vehicle is used. This causes a problem in durability of the release lever, which includes the fragile portion.

PRIOR ART DOCUMENT

Patent Document

Patent Document 1: Japanese Patent No. 4036316

SUMMARY OF THE INVENTION

Problems that the Invention is to Solve

Accordingly, it is an objective of the present invention to provide a door lock release mechanism for a vehicle door that prevents the door from being unlocked through unlocking operation of a latch open lever caused by deformation of the door in a side collision and solves a durability problem of a release lever simply through a lock release prevention member arranged in a spacer for restricting inward displacement of an outside handle caused by the deformation of the door.

Means for Solving the Problems

To achieve the foregoing objective, a door lock release mechanism for a door of a vehicle according to the present invention includes a link lever that is connected to an outside handle of a vehicle door and pivotally attached to a fixed component of the door, a latch open lever of a door locking device, and a release lever that extends in a vertical direction and has an upper end connected to the link lever and a lower end engaged with the latch open lever. The link lever is pivoted in an opening direction through an opening operation of the outside handle. The pivoting of the link lever causes a downward opening operation of the release lever to bring about an opening operation of the latch open lever, thereby causing the door lock release mechanism to release a latch of the door locking device. The door lock release mechanism further includes a spacer and a lock release prevention member. The spacer is fixed to the fixed component and restricts displacement of the outside handle in an inward direction of the vehicle at the time of deformation of the door. The lock release prevention member is mounted on the spacer and is arranged outside a normal path of an opening operation of the door lock release mechanism. In a side collision, the lock release prevention member is moved to a position in the path of the opening operation of the door lock release mechanism to restrict the opening operation of the latch open lever of the door lock release mechanism through deformation of the door caused by the side collision.

In this configuration, simply through the lock release prevention member mounted in the spacer for restricting inward displacement of an outside handle, an unlocking operation of a latch open lever is prevented from being brought about by door deformation caused by a side collision and thus the door is prevented from being unlocked. Also, the lock release prevention member arranged in the spacer, which is not operated for a normal time, makes it unnecessary to form a fragile portion in the release lever. The release lever, which is used frequently, is thus free from a durability problem.

The release lever preferably has a claw portion. The lock release prevention member is preferably an engagement portion arranged in the spacer. The deformation of the door caused by the side collision preferably moves the engagement portion to such a position that the engagement portion is located in a path of an opening operation of the claw portion of the release lever to engage with the claw portion, thereby restricting the opening operation of the latch open lever of the door lock release mechanism.

In this configuration, the positions of the release lever and the spacer fixed to the fixed component relative to each other change in correspondence with the inertial force produced at an initial stage of vehicle deformation caused by a car collision. The lock release prevention member, which is arranged in the spacer, is thus moved to a position below a claw portion of the release lever, which has been displaced. This prevents a downward opening operation of the release lever, thus preventing an opening operation of the latch open lever.

The spacer preferably includes a spacer body that is located inward of the outside handle and an extended portion that extends downward from the spacer body and is located outward of the latch open lever. The lock release prevention member is preferably provided in the extended portion and arranged outside a normal path of the opening operation of the latch open lever. In a side collision, the lock release prevention member is preferably moved to a position in the path of the opening operation of the latch open lever through the deformation of the door caused by the side collision, thereby restricting the opening operation of the latch open lever.

In this configuration, deformation of the vehicle door caused by a side collision moves the lock release prevention member to a position on the path of the opening operation of the latch open lever. This allows the lock release prevention member to directly restrict the opening operation of the latch open lever.

The spacer is preferably formed integrally with the fixed component and arranged in an outward direction of a body of the vehicle from the latch open lever. The lock release prevention member is preferably provided in the spacer and is arranged outside a normal path of the opening operation of the latch open lever. In a side collision, the lock release prevention member is preferably moved to a position on the path of the opening operation of the latch open lever through the deformation of the door caused by the side collision, thereby restricting the opening operation of the latch open lever.

In this configuration, deformation of the vehicle door caused by a side collision moves the lock release prevention member to a position on the path of the opening operation of the latch open lever. This allows the lock release prevention member to directly restrict the opening operation of the latch open lever.

The latch open lever preferably includes an opening rod linked to the lower end of the release lever. In a side collision the lock release prevention member is preferably moved to a position on a path of opening operation of the opening rod of the latch open lever through the deformation of the door caused by the side collision, thereby restricting the opening operation of the latch open lever.

In this configuration, deformation of the vehicle door caused by a side collision moves the lock release prevention member to a position on the path of the opening operation of the opening rod of the latch open lever. This allows the unlocking prevention member to directly restrict the opening operation of the latch open lever.

DETAILED DESCRIPTION OF THE PREFERRED EMBODIMENTS

Figure 1:
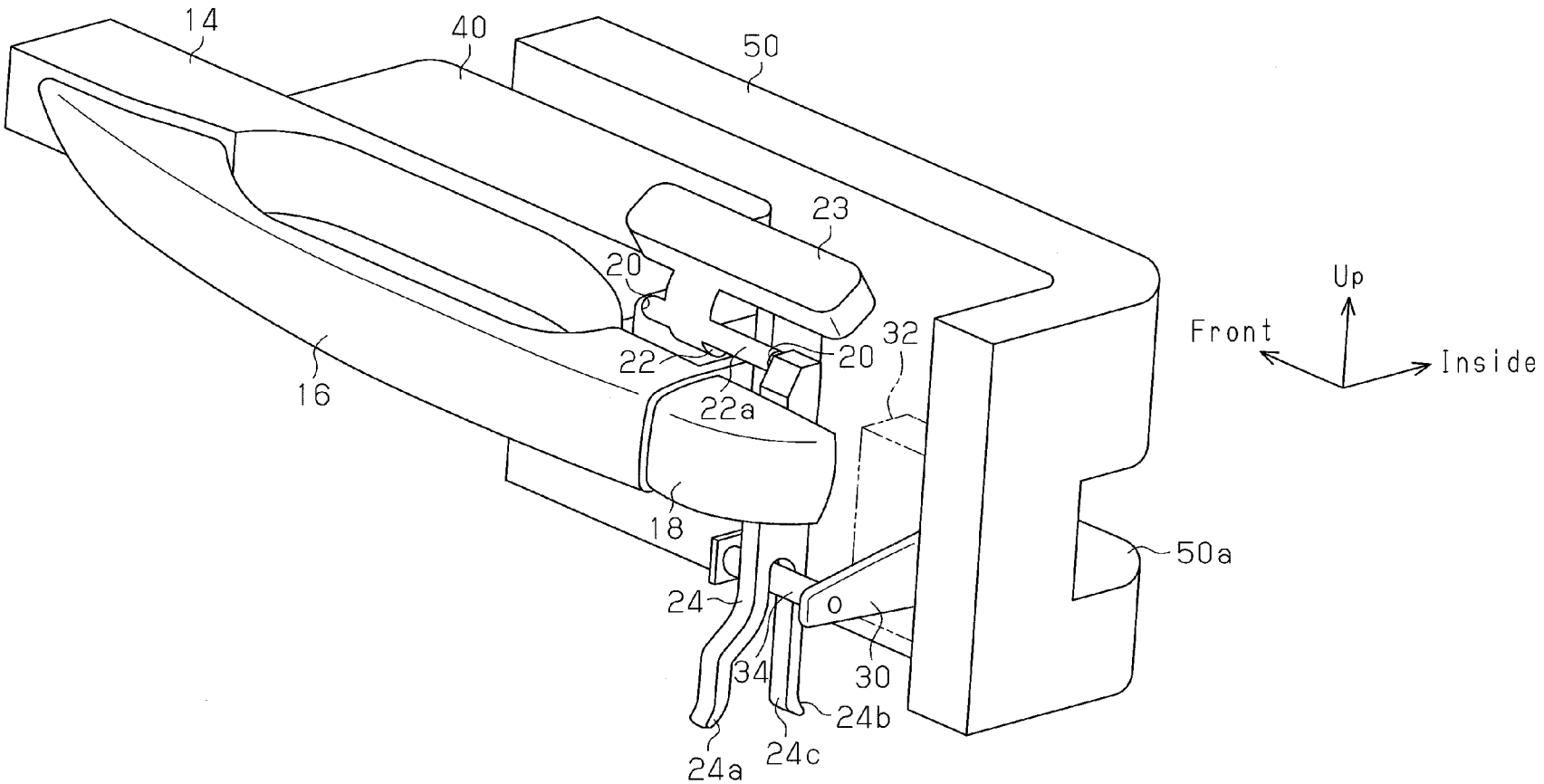
FIG. 1 is a perspective view schematically showing a door lock release mechanism for doors of a vehicle according to a first embodiment of the present invention.

A first embodiment of the present invention, which is a door lock release mechanism for doors of a vehicle, will now be described with reference to FIGS. 1 to 9. In the first embodiment, a front end of a vehicle will be referred to as forward end and a rear end of the vehicle will be referred to as rearward end. An inner side of the vehicle will be referred to as inward side and an outer side of the vehicle will be referred to as outward side. In FIG. 1, an outer panel 10 (see FIG. 2) of a door of the vehicle is omitted for illustrative purposes.

Figure 2:
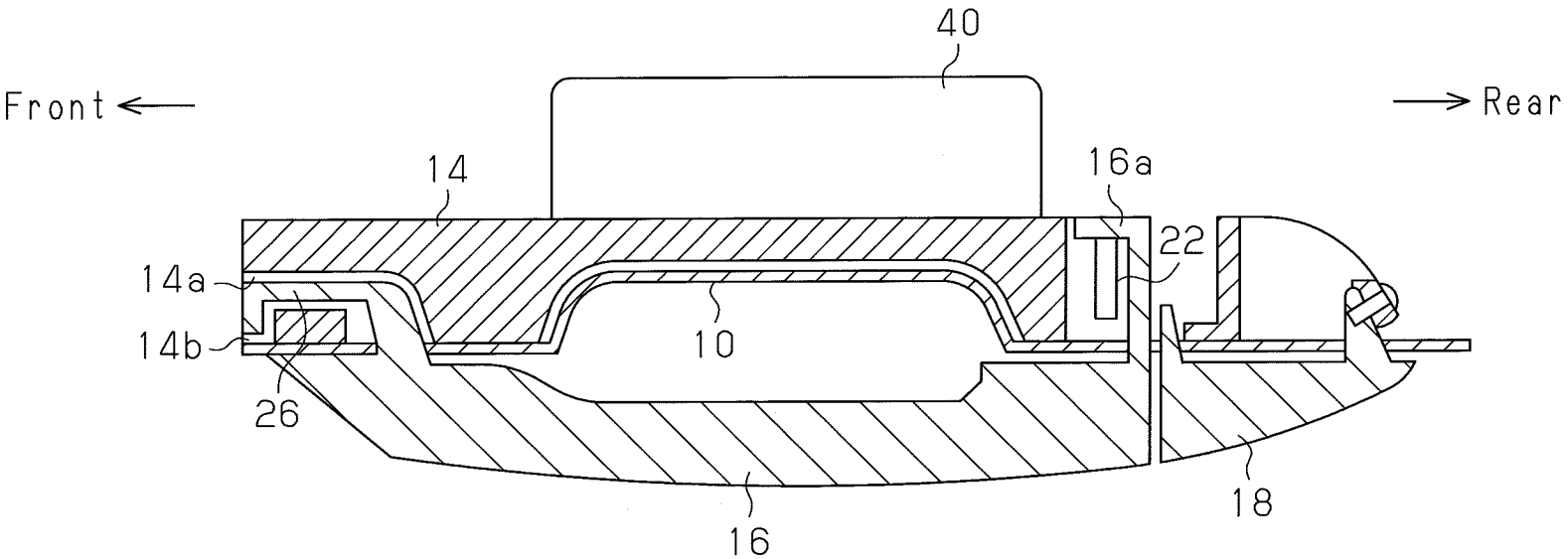
FIG. 2 is a plan view showing members in an outside handle and the proximity of the outside handle.
Figure 3:
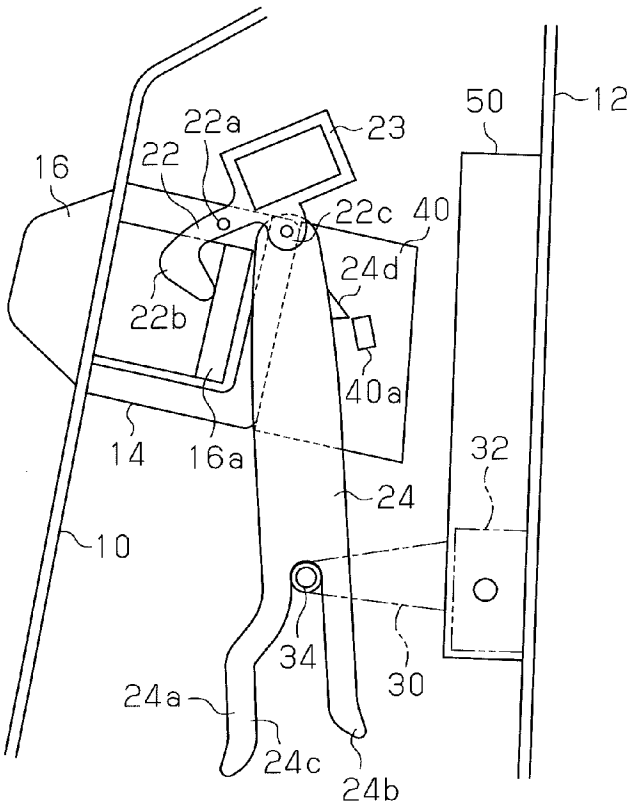
FIG. 3 is a side view showing the outside handle of the door lock release mechanism in a non-operating state.

As shown in FIGS. 2 and 3, a handle base 14 serving as a fixed component is fixed to an inner side of the outer panel 10 of a vehicle door at such a position that the handle base 14 is located between the outer panel 10 and an inner panel 12. With reference to FIG. 1, an outside handle 16 is rotationally attached to a front end portion of the handle base 14 and can be manipulated from outside the vehicle. As illustrated in FIG. 2, a handle cap 18 is arranged in the vicinity of the rear end, which is the free end, of the outside handle 16 in such a manner as to cover a portion of the outer surface of the outer panel 10.

A pair of bearing portions 20 are formed at the rear end of the handle base 14, which corresponds to the free end of the outside handle 16. The bearing portions 20 support a bell crank 22 serving as a link lever in such a manner that the bell crank 22 is allowed to rotate about a shaft 22*a*, which extends in a forward-rearward direction of the vehicle, or, in other words, a horizontal direction.

Referring to FIG. 2, an engagement portion 16*a* having a substantially L-shaped cross section, which extends in an inward direction of the vehicle, projects from a rear end portion of the outside handle 16. The engagement portion 16*a* extends through the outer panel 10 and is received in the outer panel 10. Also, as shown in FIG. 2, a handle support portion 26 having a substantially L-shaped cross section, which extends through the outer panel 10 to be received in the outer panel 10 and projects further forward, is formed at a front end portion of the outside handle 16.

The handle support portion 26 is received in a support hole 14*a* of the handle base 14 through the outer panel 10 and is engageable with the engagement portion 14*b* of the handle base 14. Specifically, the handle support portion 26 of the outside handle 16 is engaged with the engagement portion 14*b* of the handle base 14. This allows the outside handle 16 to rotate outward with respect to the handle base 14 about the engaged portion as the base point. When the outside handle 16 is rotated outward with respect to the handle base 14, the engagement portion 16*a* is moved toward the exterior of the vehicle in such a manner as to approach the outer panel 10.

As illustrated in FIG. 3, the bell crank 22 is formed substantially in a C shape and pivotally supported by the handle base 14 through the shaft 22*a*, with an opening of the bell crank 22 faced downward. The bell crank 22 includes a first arm 22*b*. The first arm 22*b* contacts the engagement portion 16*a* of the outside handle 16 from outside and is pulled in an outward direction of the vehicle through the engagement portion 16*a* in response to an opening operation of the outside handle 16. Specifically, when the outside handle 16 is manipulated to open the door, the first arm 22*b* is pulled to pivot the bell crank 22 in an opening direction about the shaft 22*a* as a fulcrum. The shaft 22*a* has an urging means (not shown) such as a torsion coil spring. The urging means urges the outside handle 16 and the bell crank 22 to corresponding normal positions at which the outside handle 16 and the bell crank 22 are located before the outside handle 16 is manipulated.

The bell crank 22 has a second arm 22*c*, which is formed at the opposite side of the bell crank 22 from the first arm 22*b* with the shaft 22*a* arranged between the second arm 22*c* and the first arm 22*b*. The upper end of the release lever 24 is rotationally linked to the second arm 22*c*.

A counterweight 23 is embedded in an upper portion of the second arm 22*c* of the bell crank 22. When impact from the exterior, which is a side collision, occurs, the counterweight 23 operates to stop movement of the outside handle 16 toward the exterior of the vehicle. However, for certain impact angles and impact positions in the side collision, the counterweight 23 may only have a limited effect in stopping the movement of the outside handle 16 toward the exterior of the vehicle.

The lower end of the release lever 24 is engaged with the latch open lever 30. Accordingly, when the outside handle 16 is manipulated to open the door and thus the first arm 22*b* is pulled, the bell crank 22 moves the release lever 24 downward for the opening operation.

With reference to FIG. 3, the latch open lever 30 is attached to a door locking device 32, which is mounted in the inner panel 12, rotationally in upward and downward directions to operate the door locking device 32. The door locking device 32 is a publicly known device. The latch open lever 30 is engaged with a non-illustrated detent lever formed in the door locking device 32. When the latch open lever 30 is operated downward, the detent lever is operated to separate a latch (not shown) formed in the door locking device from a striker 150 (see FIG. 7), which is formed in the vehicle body. This unlocks the door of the vehicle. Specifically, as illustrated in FIG. 1, the striker 150 is selectively engaged with and disengaged from the latch (not shown) through a window 50*a* formed in a component 50 to which the door locking device 32 is fixed.

Referring to FIG. 1, an opening rod 34 is supported by a distal portion of the latch open lever 30. The opening rod 34 extends in the direction in which the shaft 22*a* of the release lever 24 extends with respect to the distal portion of the latch open lever 30, or, in other words, is arranged parallel to the shaft 22*a*.

The release lever 24 is shaped like a flat plate and has a pair of leg portions 24*a*, 24*b*, which are formed at the distal end of the release lever 24 in a fork-like shape. A slit 24*c* having a width slightly greater than the diameter of the opening rod 34 is formed between the leg portions 24*a*, 24*b*. The opening rod 34 is slidably received in the slit 24*c*. When the release lever 24 is moved downward for an opening operation, the open rod 34 is engaged with the inner upper end of the slit 24*c*. This rotates the open lever 30 downward, so that the door lock by the door locking device 32 is released. A claw portion 24*d* protrudes toward the inner panel 12 from the inner side of the release lever 24.

A spacer 40 is fixed to the surface of the handle base 14 facing the inner panel 12. Specifically, the spacer 40 is located inward in the vehicle compared to the outside handle 16. The spacer 40 is arranged in the space formed between the handle base 14 and the component 50 arranged on the inner surface of the inner panel 12. As a result, when a side collision causes deformation of the outer panel 10 in an inward direction of the vehicle, the spacer 40 is brought into contact with the component 50, thus restricting depression, or displacement, of the handle base 14 and the outside handle 16 in the inward direction of the vehicle and displacement and deformation of the outer panel 10.

In the first embodiment, the spacer 40 is formed by a block, which is a solid body. However, the spacer 40 is not restricted to being formed by a block but may be formed by a frame body in a three-dimensional manner.

The outside handle 16, the handle base 14, the spacer 40, the bell crank 22, and the counterweight 23 configure a handle unit.

Figure 4:
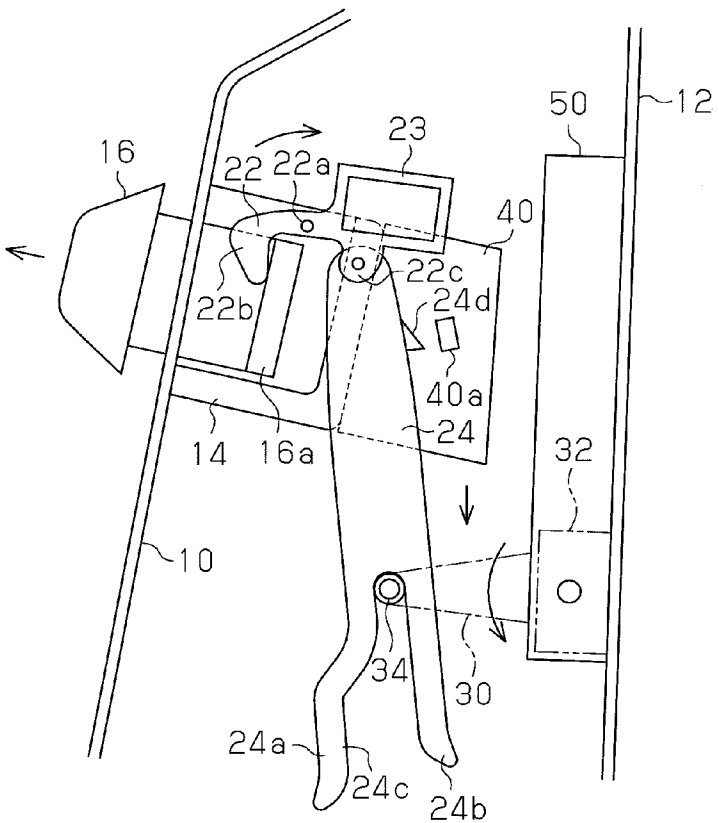
FIG. 4 is a side view showing the outside handle of the door lock release mechanism in an operating state.

As illustrated in FIG. 3, an engagement portion 40*a* serving as a lock release prevention member is projected from the side surface of the spacer 40 facing the release lever 24 in the extending direction of the shaft 22*a*. During a normal time, which is when the outside handle 16 is not manipulated and a side collision does not happen, the engagement portion 40*a* is arranged at a position spaced from a claw portion 24*d* of the release lever 24, as shown in FIG. 3. Also when the outside handle 16 is manipulated to open the door, as illustrated in FIG. 4, the engagement portion 40*a* is arranged at a position spaced from the claw portion 24*d* of the release lever 24 and maintained outside the path of the opening operation of the release lever 24. The engagement portion 40*a* is thus held at such a position that the engagement portion 40*a* is prevented from interfering with the downward opening operation of the release lever 24.

Figure 5:
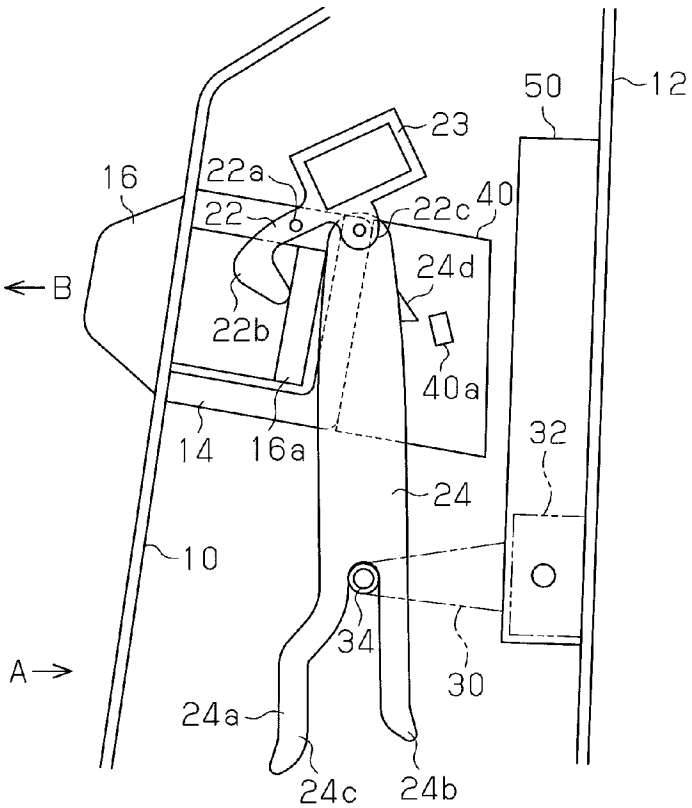
FIG. 5 is a side view showing the outside handle of the door lock release mechanism in a state immediately after a side collision.
Figure 6:
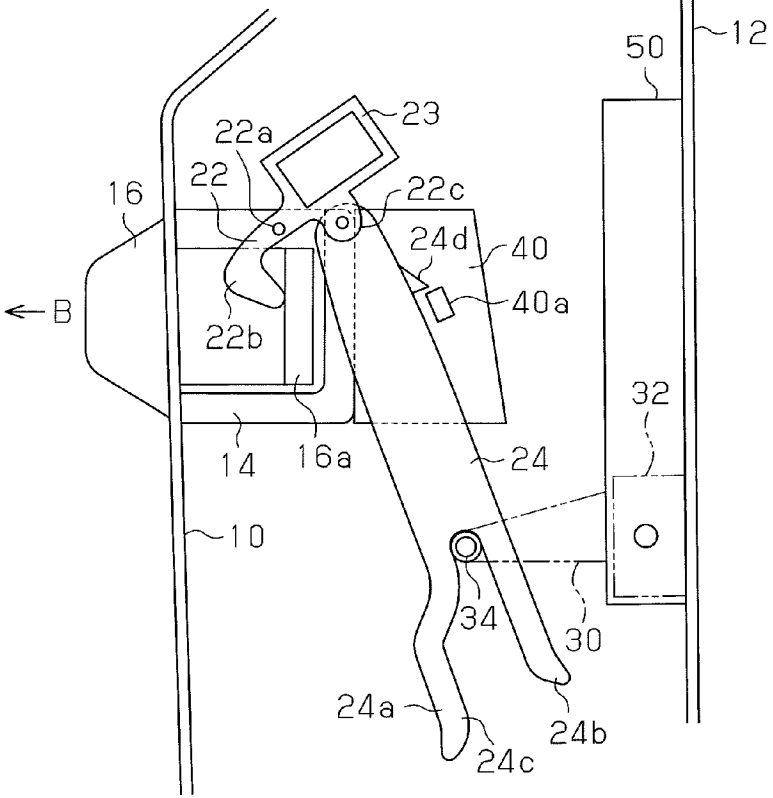
FIG. 6 is a side view showing the outside handle of the door lock release mechanism in a lock release prevented state at the time of a side collision.

In contrast, when the vehicle is involved in a side collision, as indicated by arrow A in FIG. 5, the handle unit as a whole, including the outside handle 16, the handle base 14, the spacer 40, the bell crank 22, and the counterweight 23, is moved in the outward direction of the vehicle due to the inertial force acting in the direction represented by arrow B. Movement of the handle unit in the direction represented by arrow B due to the inertial force inclines the release lever 24 in the outward direction of the vehicle about the opening rod 34, as illustrated in FIG. 6. In this case, the engagement portion 40*a* of the spacer 40 is moved to a position below the claw portion 24*d*, which has been displaced, and arranged at such a position that the engagement portion 40*a* prevents downward movement of the release lever 24 in a car collision.

The door lock release mechanism for the door locking device 32 of the first embodiment is configured by the bell crank 22, the latch open lever 30, and the release lever 24.

Figure 7:
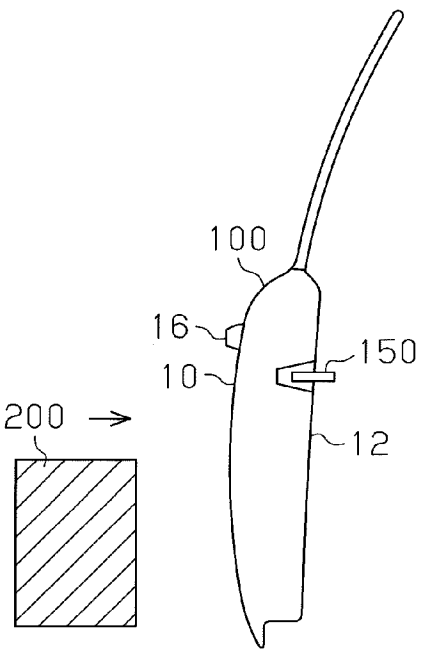
FIG. 7 is a view illustrating a state of a vehicle door before a side collision.
Figure 8:
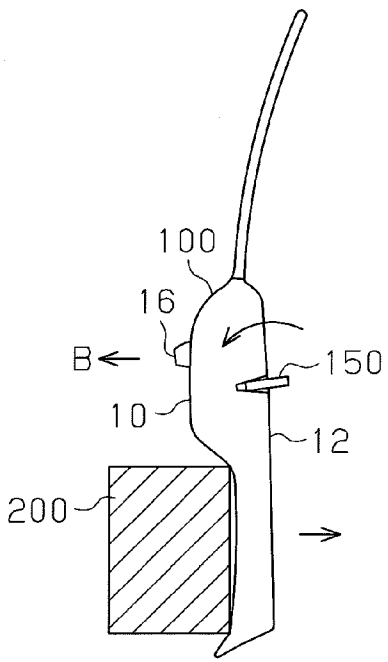
FIG. 8 is a view illustrating a state of the vehicle door at an initial state of the side collision.
Figure 9:
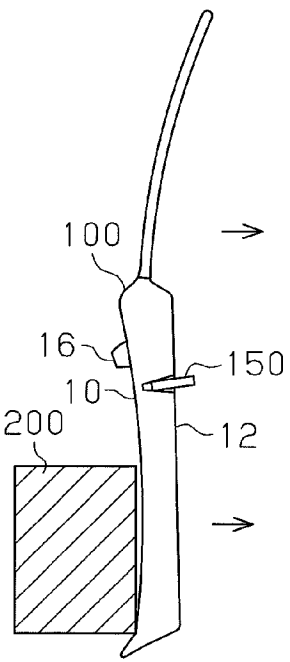
FIG. 9 is a view illustrating a state of the vehicle door after the initial state of the side collision.

Operation of the door lock release mechanism, which is configured as described above, will hereafter be described. FIGS. 7, 8, and 9 schematically illustrate a vehicle door 100 in a state before a side collision, a state at an initial stage of deformation caused by the side collision, and a state after the initial stage of the deformation caused by the collision, respectively, at the time when a side collision of the vehicle door 100 is carried out with a side surface collision barrier (hereinafter, referred to as a "side collision barrier").

When a side collision barrier 200 strikes the vehicle door 100 as illustrated in FIGS. 7 and 8, the door as a whole rotates about the striker 150, which is locked in a state engaged with the latch (not shown) of the door locking device 32. At this stage, which is an initial stage of deformation of the vehicle door 100, inertial force acting in the direction represented by arrow B in FIGS. 8 and 5 acts on the outer panel 10 of the vehicle door 100 and the handle unit as a whole, which are located above the striker 150. This deforms the outer panel 10 in the outward direction of the vehicle and displaces the handle unit as a whole in the outward direction of the vehicle.

After the initial stage of the deformation of the vehicle door caused by the collision, the outer panel 10 is depressed and deformed by the side collision barrier 200 in the inward direction of the vehicle. In the period after the initial stage of the deformation of the vehicle door, as illustrated in FIG. 6, the inertial force displaces the handle unit as a whole to incline the release lever 24 in the outward direction of the vehicle. This sends the engagement portion 40*a* of the spacer 40 to a position below the claw portion 24*d*, which has been deformed, thus preventing downward movement of the release lever 24 after the collision. In this manner, by arranging the engagement portion 40*a* of the spacer 40 on the path of locking operation of the release lever 24, the locking operation of the release lever 24 is restricted; thus the locking operation of the latch open lever 30 is prevented from being caused by the release lever 24.

Particularly, in the first embodiment, the handle unit as a whole, including the spacer 40, is displaced by the inertial force at the initial stage of the deformation of the vehicle door caused by the side collision, as illustrated in FIG. 5. This moves the engagement portion 40*a* to a position below the claw portion 24*d*. The downward opening operation of the release lever 24 is thus prevented from an early stage.

The first embodiment has the advantages described below.

(1) In the door lock release mechanism of the first embodiment, manipulation of the outside handle 16 for opening the door pivots the bell crank 22 (the link lever) in the opening direction. This causes a downward opening operation of the release lever 24, which leads to an opening operation of the latch open lever 30. The latch of the door locking device 32 is thus disengaged. The door locking mechanism includes the spacer 40 and the engagement portion 40*a* (the lock release prevention member). The spacer 40 is fixed to the handle base 14 (the fixed component) and restricts depression of the outside handle in the inward direction of the vehicle when the vehicle door is deformed. The engagement portion 40*a* is formed in the spacer 40 and, in a normal time, arranged outside the path of the opening operation of the door lock release mechanism. If the vehicle door deforms in a side collision, the engagement portion 40*a* is moved to a position on the path of the opening operation of the door lock release mechanism. The engagement portion 40*a* thus restricts the opening operation of the latch open lever 30.

Accordingly, simply by forming the engagement portion 40*a* in the spacer 40 to restrict depression of the outside handle 16 in the inward direction of the vehicle at the time when the door is deformed, unlocking operation of the latch open lever 30 is prevented when the door deforms in a side collision. The door is thus prevented from being unlocked. Additionally, unlike the above-described technique of Patent Document 1, it is unnecessary to form a fragile portion in the release lever 24. The release lever, which is used frequently, is thus more durable.

(2) In the door lock release mechanism of the first embodiment, when the vehicle door deforms in a side collision, the engagement portion 40*a* of the spacer 40 is moved to a position on the path of the opening operation of the claw portion 24*d* of the release lever 24 at which the engagement portion 40*a* becomes engaged with the claw portion 24*d*. The engagement portion 40*a* thus restricts the opening operation of the latch open lever of the door lock release mechanism.

In other words, inertial force produced at the initial stage of the deformation of the vehicle door caused by the collision changes the positions of the release lever 24 and the spacer 40 fixed to the handle base 14 (the fixed component) relative to each other. Through such change, the engagement portion 40*a* (the lock release prevention member) formed in the spacer 40 is sent to a position below the claw portion 24*d* of the release lever 24, which has been displaced. This prevents the downward opening operation of the release lever 24, thus preventing the opening operation of the latch open lever 30.

(3) The door lock release mechanism of the first embodiment is formed simply by adding the claw portion 24*d* and the engagement portion 40*a* to the release lever 24 and the spacer 40, respectively, without a great design change in the configuration of a conventional door lock release mechanism. In other words, the effects of the invention are easily brought about by changing a conventional release lever without a claw portion 24*d* to the release lever 24 having the claw portion 24*d* and a spacer without an engagement portion 40*a* to the spacer 40 including the engagement portion 40*a*. As a result, the designs of the components configuring the door lock release mechanism do not have to be changed greatly. The cost for the molds for shaping the components is thus prevented from increasing.

A second embodiment of the present invention will now be described with reference to FIGS. 10 and 11. Same or like reference numerals are given to components of the second embodiment that are the same as or like corresponding components of the first embodiment and repeated description of these components is omitted. The description below is thus focused on the differences between the second embodiment and the first embodiment.

In the second embodiment, the engagement portion 40*a* and the claw portion 24*d* in the configuration of the door lock release mechanism of the first embodiment are omitted. Instead, as illustrated in FIG. 10, the spacer 40 of the first embodiment is used as a spacer body. Additionally, an extended portion 60, which is extended from a lower portion of the spacer body 40 downward with respect to the handle base 14, is arranged. The extended portion 60 is formed in a block-like shape and thus extended in a direction perpendicular to the sheet surface of FIG. 10 and arranged at such a position that the extended portion 60 is located between the outer panel 10 and the component 50 at a position below the handle base 14. Referring to FIG. 10, the extended portion 60 has a preventing portion 60*a*, which projects in the inward direction of the vehicle. An upper surface 60*b* of the preventing portion 60*a* is formed in a manner inclining downward toward the distal end of the preventing portion 60*a*. In the second embodiment, the preventing portion 60*a* is formed as a projection. When the outer panel 10 is deformed in the inward direction of the vehicle and the extended portion 60 is displaced correspondingly in the inward direction of the vehicle, the extended portion 60 is sent to a position between the component 50 and the outer panel 10. In this state, the block-like shape of the extended portion 60 prevents inward movement of the outer panel 10.

Figure 10:
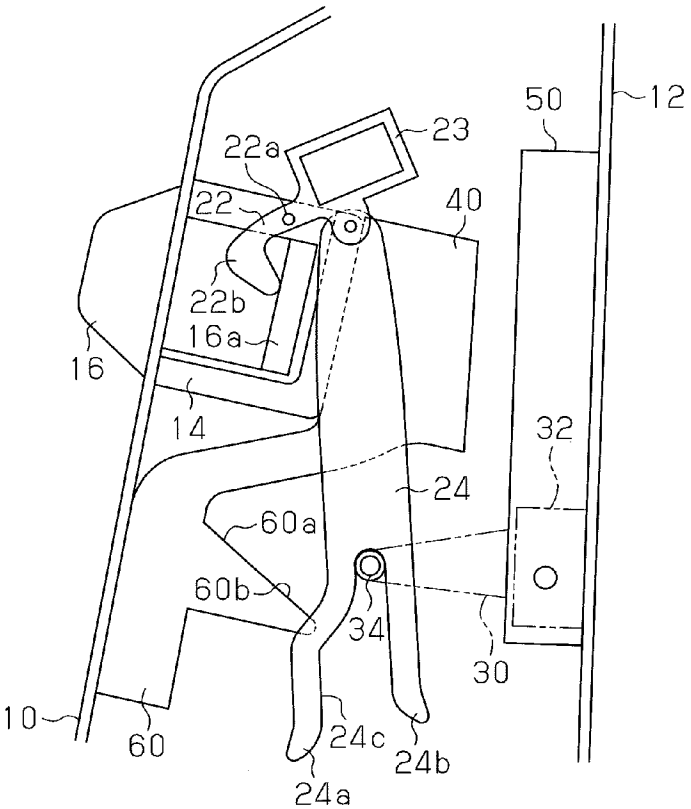
FIG. 10 is a side view showing an outside handle of a door lock release mechanism according to a second embodiment of the invention in a non-operating state.

Both at a normal time when there is no side collision, that is, when the outside handle 16 is not operated, and at the time when the outside handle 16 is operated, the preventing portion 60*a* is spaced from the opening rod 34, with reference to FIG. 10. The preventing portion 60*a* is thus arranged at such a position that the preventing portion 60*a* is maintained outside the operating path of the opening rod 34 at the time of a downward opening operation of the latch open lever 30 and the opening rod 34. Specifically, in the second embodiment, the path of the opening operation of the latch open lever 30 includes the operating path of the opening rod 34.

Figure 11:
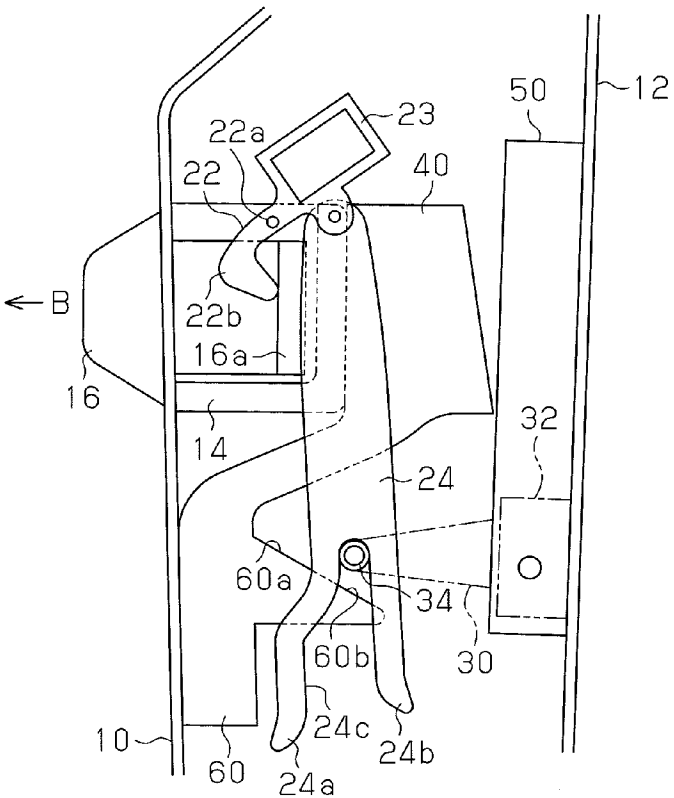
FIG. 11 is a side view showing the outside handle of the door lock release mechanism of the second embodiment in a lock release prevented state at the time of a side collision.

When the vehicle is involved in a side collision, as illustrated in FIG. 11, the handle unit as a whole, including the outside handle 16, the handle base 14, the spacer body 40, the bell crank 22, and the counterweight 23, is displaced in the outward direction of the vehicle due to inertial force acting in the direction represented by arrow B and the outer panel 10 is deformed in the inward direction of the vehicle. Such deformation of the outer panel 10 in the inward direction of the vehicle displaces the extended portion 60 in the inward direction of the vehicle. The preventing portion 60*a* of the extended portion 60 is thus sent to a position below the opening rod 34, or, in other words, a position on the path of the opening operation of the opening rod 34. In this manner, the preventing portion 60*a* is deployed at such a position to prevent downward movement of the release lever 24 after the collision. The preventing portion 60*a* corresponds to the lock release prevention member.

The door lock release mechanism of the second embodiment has the characteristics described below.

(4) In the door lock release mechanism of the second embodiment, the spacer is configured to include the spacer body 40, which is arranged inward in the vehicle compared to the outside handle 16, and the extended portion 60, which is extended downward from the spacer body 40 and arranged outward in the vehicle body compared to the latch open lever 30. The preventing portion 60*a* (the lock release prevention member), which is formed in the extended portion 60, is arranged outside the path of the opening operation of the latch open lever 30 in the normal time. When the vehicle door deforms in a side collision, the preventing portion 60*a* is sent to a position on the path of the opening operation of the latch open lever 30. The preventing portion 60*a* thus restricts the opening operation of the latch open lever 30.

As a result, deformation of the vehicle door caused by the side collision moves the preventing portion 60*a* of the extended portion 60 to a position on the path of the opening operation of the latch open lever 30. The preventing portion 60*a* thus directly restricts the opening operation of the latch open lever 30.

(5) In the door lock release mechanism of the second embodiment, the latch open lever 30 includes the opening rod 34, which is linked to the lower end of the release lever 24.

The preventing portion 60*a* (the lock release prevention member) is sent to a position on the path of the opening operation of the opening rod 34 of the latch open lever 30 through deformation of the vehicle door caused by a side collision. The preventing portion 60*a* thus restricts the opening operation of the latch open lever 30. That is, the deformation of the vehicle door caused by the side collision sends the preventing portion 60*a* to a position on the path of the opening operation of the opening rod 34 of the latch open lever 30, thus allowing the preventing portion 60*a* to directly restrict the opening operation of the latch open lever 30.

(6) In the door lock release mechanism of the second embodiment, the spacer fixed to the handle base 14 is configured by the spacer body 40 and the extended portion 60. This makes it unnecessary to greatly change the configuration of a conventional door lock release mechanism. In other words, the effects of the present invention are easily brought about simply by changing a spacer without an extended portion 60 having a preventing portion 60*a* to the spacer including the spacer body 40 and the extended portion 60 including the preventing portion 60*a*.

As a result, the designs of the components configuring the door lock release mechanism do not have to be modified. The cost for the molds for shaping the components is thus prevented from increasing.

A third embodiment of the present invention will now be described with reference to FIGS. 12 and 13. Same or like reference numerals are given to components of the third embodiment that are the same as or like corresponding components of the second embodiment and repeated description of these components is omitted. The description below is thus focused on the differences between the third embodiment and the second embodiment.

In the second embodiment, the extended portion 60 is formed integrally with the spacer body 40. However, in the third embodiment, the spacer body 40 is omitted and the extended portion 60, which extends downward from the handle base 14 serving as the fixed component, is formed integrally with the handle base 14 as a spacer. The extended portion 60 is arranged at a position between the outer panel 10 and the component 50 below the handle base 14. Specifically, the extended portion 60 is formed in a block-like shape like the extended portion of the second embodiment and extends perpendicularly to the sheet surfaces of the drawings. The extended portion 60 is formed integrally with the handle base 14 and arranged outward in the vehicle body compared to the latch open lever 30. The configurations of the other components of the third embodiment are identical to the configurations of the corresponding components of the second embodiment.

Figure 12:
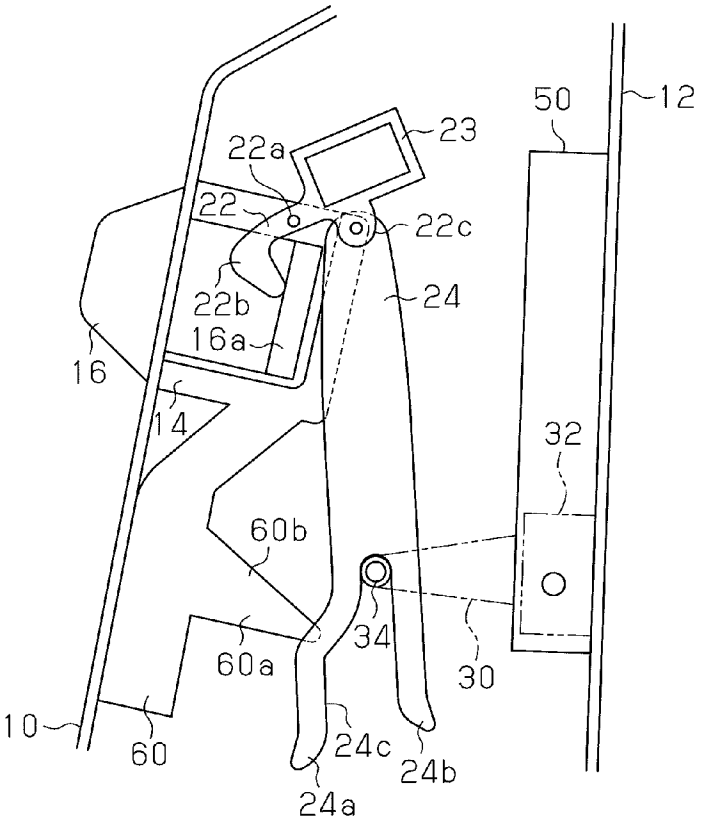
FIG. 12 is a side view showing an outside handle of a door lock release mechanism according to a third embodiment of the invention in a non-operating state.

In the third embodiment, both at a normal time when there is no side collision, or the outside handle 16 is not operated, and at the time when the outside handle 16 is manipulated, the preventing portion 60*a* is spaced from the opening rod 34, as illustrated in FIG. 12. The preventing portion 60*a* is thus arranged at such a position that the preventing portion 60*a* is maintained outside the operating path of the opening rod 34 at the time of a downward opening operation of the latch open lever 30 and the opening rod 34. Specifically, also in the third embodiment, the path of the opening operation of the latch open lever 30 includes the operating path of the opening rod 34.

Figure 13:
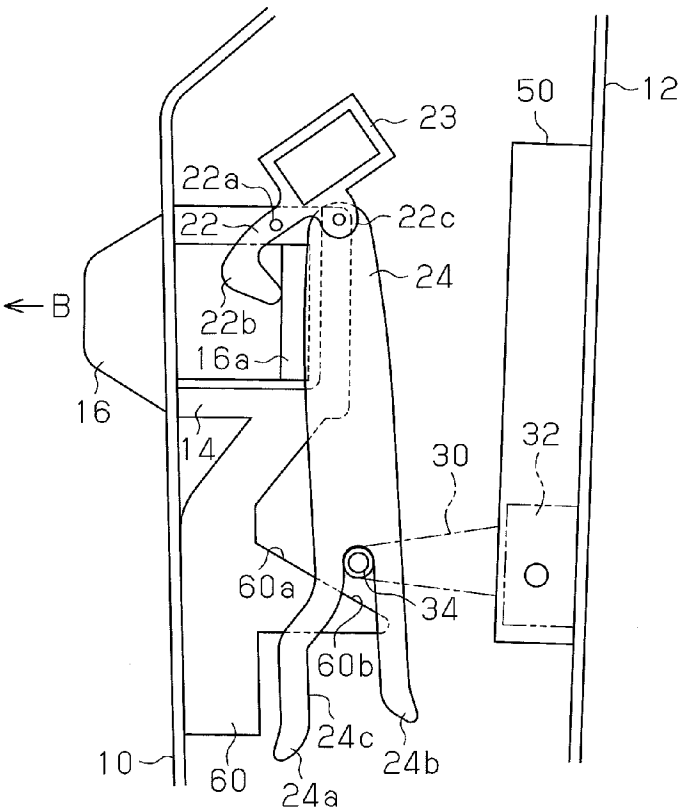
FIG. 13 is a view showing the third embodiment in a lock release prevented state at the time of a side collision.

When the vehicle is involved in a side collision, as illustrated in FIG. 13, the handle unit as a whole, including the outside handle 16, the handle base 14, the extended portion 60, the bell crank 22, and the counterweight 23, is displaced in the outward direction of the vehicle due to inertial force acting in the direction represented by arrow B and the outer panel 10 is deformed in the inward direction of the vehicle. Such deformation of the outer panel 10 in the inward direction of the vehicle displaces the extended portion 60 in the inward direction of the vehicle and thus arranges the extended portion 60 at a position between the component 50 and the outer panel 10. In this state, the extended portion 60, which has the block-like shape as has been described, restricts inward movement of the outer panel 10. Also in this state, the preventing portion 60*a* of the extended portion 60 is moved to a position below the opening rod 34, or, in other words, a position on the path of the opening operation of the opening rod 34. In this manner, the preventing portion 60*a* prevents downward movement of the release lever 24 after the collision.

The third embodiment has the characteristics described below.

(7) In the door lock release mechanism of the third embodiment, the extended portion 60 is formed integrally with the handle base 14 (the fixed component) as the spacer. The extended portion 60 is arranged outward in the vehicle body compared to the latch open lever 30. Also, the preventing portion 60*a* (the lock release prevention member) is formed in the extended portion 60 and arranged outside the path of the opening operation of the latch open lever 30 in a normal time. The preventing portion 60*a* is moved to a position on the path of the opening operation of the latch open lever 30 when the vehicle door deforms in a side collision. The preventing portion 60*a* thus restricts the opening operation of the latch open lever 30.

That is, deformation of the vehicle door caused by the side collision sends the preventing portion 60*a* to a position on the path of the opening operation of the latch open lever 30. This allows the preventing portion 60*a* to directly restrict the opening operation of the latch open lever 30.

(8) The door lock release mechanism of the third embodiment includes the extended portion 60 fixed to the handle base 14. A conventional door lock release mechanism thus can be employed effectively without necessitating a great design change in the configuration of the door lock release mechanism. In other words, the effects of the invention are easily brought about simply by replacing a handle base 14 without an extended portion 60 having a preventing portion 60*a* with a handle base having an extended portion 60 including a preventing portion 60*a*. This makes it unnecessary to change the designs of the components configuring the door lock release mechanism and thus prevents the cost for the molds for shaping the components from increasing.

The illustrated embodiments of the invention may be modified to the forms described below.

Although the preventing portion 60*a* is formed as a projection in the second and third embodiments, the preventing portion 60*a* does not necessarily have to be the projection. The preventing portion 60*a* is not restricted to any particular shape as long as the preventing portion 60*a* is shaped in a manner engageable with the engagement portion 40*a*.

In the second and third embodiments, the preventing portion 60*a* is moved to a position on the path of the opening operation of the opening rod 34 to prevent the opening operation of the opening rod 34 when a side collision occurs. However, at the time of a side collision, the preventing portion 60*a* may be sent to a position on the path of the opening operation of the latch open lever 30 to prevent the opening operation of the opening rod 34.

Although the extended portion 60 of the second embodiment is formed in a block-like shape, the extended portion 60 may be shaped like a plate. In this case, the other components are configured identically with the corresponding components of the second embodiment. The plate-like extended portion 60 may be shaped like, for example, the extended portion 60 illustrated in FIGS. 10 and 11, as viewed from beside. In this embodiment, the extended portion 60 does not function as the spacer. The extended portion 60 must include a preventing portion that is projected like the preventing portion 60a. The upper surface of the preventing portion is inclined downward toward the distal end of the preventing portion, as in the case of the upper surface 60*b*. The extended portion 60 of this embodiment operates in the same manner as the extended portion of the second embodiment, except for the function of the spacer described for the second embodiment.

A reference example will hereafter be described.

The extended portion 60 of the third embodiment is formed as a plate-like interference member 60 instead of being shaped like a block. In this case, the other components are configured identically with the corresponding components of the third embodiment. The plate-like interference member 60 may be shaped like, for example, the extended portion 60 shown in FIGS. 12 and 13, as viewed from beside. In this reference example, the interference member 60 does not function as the spacer and is arranged between the outer panel 10 and the component 50. The interference member 60 must include a preventing portion that is projected in the same manner as the preventing portion 60*a*. The upper surface of the preventing portion is inclined downward toward the distal end of the preventing portion, as in the case of the upper surface 60*b*. The interference member 60 of the reference example operates in the same manner as the extended portion 60 of the third embodiment, except for the function of the spacer described for the third embodiment.

The invention claimed is:

1. A door lock release mechanism for a door of a vehicle, comprising:

a link lever that is connected to an outside handle of a vehicle door and pivotally attached to a fixed component of the door;

a latch open lever of a door locking device attached to an inner panel of the vehicle; and a release lever that extends in a vertical direction and has an upper end connected to the link lever and a lower end engaged with the latch open lever;

wherein the link lever is pivoted in an opening direction through an opening operation of the outside handle, the pivoting of the link lever causes a downward opening operation of the release lever to bring about an opening operation of the latch open lever, thereby causing the door lock release mechanism to release a latch of the door locking device;

a spacer that is a solid block, the spacer being fixed to the fixed component and arranged between the fixed component and a component on an inner surface of the inner panel, wherein at a time of deformation of the door, the spacer contacts the component on the inner surface of the inner panel and restricts displacement of the outside handle in an inward direction of the vehicle; and a lock release prevention member mounted on the spacer, the lock release prevention member being arranged outside a normal path of an opening operation of the door lock release mechanism, and in a side collision, the lock release prevention member being moved to a position in the path of the opening operation of the door lock release mechanism to restrict the opening operation of the latch open lever of the door lock release mechanism through displacement of the handle unit in an outward direction of the vehicle due to deformation of the door caused by the side collision.

2. The door lock release mechanism according to claim 1, wherein the release lever has a claw portion, the lock release prevention member is an engagement portion arranged in the spacer, and the deformation of the door caused by the side collision moves the engagement portion to such a position that the engagement portion is located in a path of an opening operation of the claw portion of the release lever to engage with the claw portion, thereby restricting the opening operation of the latch open lever of the door lock release mechanism.

3. The door lock release mechanism according to claim 1, wherein the spacer includes a spacer body that is located inward of the outside handle and an extended portion that extends downward from the spacer body and is located outward of the latch open lever, and the lock release prevention member is provided in the extended portion and arranged outside a normal path of the opening operation of the latch open lever, and in a side collision, the lock release prevention member is moved to a position in the path of the opening operation of the latch open lever through the deformation of the door caused by the side collision, thereby restricting the opening operation of the latch open lever.

4. The door lock release mechanism according to claim 1, wherein the spacer is formed integrally with the fixed component and arranged in an outward direction of a body of the vehicle from the latch open lever, and the lock release prevention member is provided in the spacer and is arranged outside a normal path of the opening operation of the latch open lever, and in a side collision the lock release prevention member being moved to a position on the path of the opening operation of the latch open lever through the deformation of the door caused by the side collision, thereby restricting the opening operation of the latch open lever.

5. The door lock release mechanism according to claim 4, wherein the latch open lever includes an opening rod linked to the lower end of the release lever, and in a side collision the lock release prevention member is moved to a position on a path of opening operation of the opening rod of the latch open lever through the deformation of the door caused by the side collision, thereby restricting the opening operation of the latch open lever.

* * * * *